US007488914B2

(12) United States Patent
Kahnert et al.

(10) Patent No.: US 7,488,914 B2
(45) Date of Patent: Feb. 10, 2009

(54) PLUNGER SWITCH

(75) Inventors: Christopher A. Kahnert, Euclid, OH (US); Muni Polavaram, North Royalton, OH (US)

(73) Assignee: Delta Systems, Inc., Streetsboro, OH (US)

( * ) Notice: Subject to any disclaimer, the term of this patent is extended or adjusted under 35 U.S.C. 154(b) by 0 days.

(21) Appl. No.: 11/696,241

(22) Filed: Apr. 4, 2007

(65) Prior Publication Data

US 2008/0029378 A1 Feb. 7, 2008

Related U.S. Application Data

(60) Provisional application No. 60/835,309, filed on Aug. 3, 2006.

(51) Int. Cl.
*H01H 15/24* (2006.01)

(52) U.S. Cl. ..... 200/538; 200/16 B

(58) Field of Classification Search ..... 200/538, 200/16 B

See application file for complete search history.

(56) References Cited

U.S. PATENT DOCUMENTS

| | | | | |
|---|---|---|---|---|
| 3,341,671 | A * | 9/1967 | Anater et al. | 200/16 B |
| 4,839,478 | A | 6/1989 | Howard | |
| 4,894,019 | A | 1/1990 | Howard | |
| 4,924,046 | A | 5/1990 | Howard | |
| 5,221,816 | A * | 6/1993 | Williams | 200/16 B |
| 5,528,007 | A | 6/1996 | Williams et al. | |
| 5,662,213 | A | 9/1997 | Kattler et al. | |
| 5,756,947 | A | 5/1998 | Trimble, Jr. et al. | |
| 5,775,482 | A | 7/1998 | Wolfe et al. | |
| 5,929,407 | A * | 7/1999 | Ziem | 200/61.89 |
| 6,457,545 | B1 | 10/2002 | Michaud et al. | |
| 6,618,022 | B2 | 9/2003 | Harvey | |
| 6,648,092 | B2 | 11/2003 | Michaud et al. | |
| 7,064,639 | B2 | 6/2006 | Harvey et al. | |
| 7,131,509 | B2 | 11/2006 | Harvey et al. | |
| 7,168,519 | B2 | 1/2007 | Harvey et al. | |
| 7,241,958 | B1 * | 7/2007 | Pierce et al. | 200/16 B |
| 2004/0201288 | A1 | 10/2004 | Harvey et al. | |
| 2006/0022780 | A1 | 2/2006 | Harvey et al. | |

* cited by examiner

*Primary Examiner*—Elvin G Enad
*Assistant Examiner*—Lheiren Mae A Anglo
(74) *Attorney, Agent, or Firm*—Tarolli, Sundheim, Covell & Tummino LLP

(57) ABSTRACT

A switch is disclosed having a switch housing defining a housing interior and an access opening that extends through a wall of the housing to the housing exterior. An actuator assembly including a shaft constrained by said housing moves along a path from a normal position to an actuated position as well as a momentary position. The shaft has an actuating portion which extends outwardly from the housing interior through the access opening. A shaft body inside the housing including a generally planar contact support that supports a number of switch contacts. A housing base positions a number of terminals having conductive surfaces for biased engagement with selected switch contacts to form an electrical path between terminals when the actuator assembly is in one of either the normal, actuated or momentary positions.

22 Claims, 13 Drawing Sheets

PLUNGER SWITCH

RELATE BACK

The present application claims priority from U.S. Provisional patent application Ser. No. 60/835,309 filed Aug. 3, 2006 entitled "Plunger Switch" and which is incorporated herein by reference.

FIELD OF THE INVENTION

The invention relates to electrical switches, and more particularly to an electrical switch assembly including a bridging contact which is carried by a moveable shaft that selectively bridges a gap between spaced terminals depending on a position of the shaft.

BACKGROUND ART

Electrical switches using push button or plunger type switch actuators have many applications including use in automobile car doors, ignition circuits, power take-offs for lawn mowers and the like. These push buttons may be normally open, normally closed or a combination of the two.

It is possible to construct switches having more than two terminals which combine the features of normally open and normally closed switches. For example, a "double-pole double-throw" switch behaves as a normally open switch and a normally closed switch in parallel operated by a single plunger. When the plunger is in a normal position, one pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Several proposals have been made with respect to switches in which torsion springs, leaf springs or "V"-springs are carried by plungers and used to bridge gaps between spaced terminals when the plungers are appropriately positioned. Such springs must be secured to the plungers so that the springs do not pull loose as the plungers move them into or away from engagement with the terminals. One such proposal uses a wire torsion spring having a central coil mounted on a post projecting from a surface of the plunger. An advantage of this mounting technique is that the spring may be coupled to the plunger without resort to grease to hold the parts together during assembly prior to welding. A drawback to this technique is that forming the loop which engages the post increases the cost of the spring.

U.S. Pat. No. 5,528,007 to Williams (incorporated herein by reference) concerns a plunger switch having a plunger, a retainer, a pair of terminals and an electrically-conducting wiper contact having a curved or bent middle portion defining two oppositely directed legs on either side of the middle portion. The retainer cooperates with the plunger to carry the wiper contact as the plunger moves between a normal and an actuated position. The terminals have facing contact surfaces for biased engagement with the portions of the legs exposed by the plunger and retainer to form an electrical path between the terminals when the plunger is in the actuated position. The plunger and the retainer are coupled together by arms which project from either the plunger or the retainer. The wiper contact is secured between the plunger and retainer without the need for forming a central loop in the wiper contact for engagement by the plunger.

SUMMARY

A switch is disclosed having a switch housing defining a housing interior and an access opening that extends through a wall of the housing to the housing exterior. An actuator assembly including a shaft constrained by said housing moves along a path from a normal position to an actuated position as well as a momentary position. The shaft has an actuating portion which extends outwardly from the housing interior through the access opening. A shaft body inside the housing including a generally planar contact support that supports a number of switch contacts. A housing base positions a number of terminals having conductive surfaces for biased engagement with selected switch contacts to form an electrical path between terminals when the actuator assembly is in one of either the normal, actuated or momentary positions.

These and other advantages and features are described with reference to the accompanying drawings.

EXEMPLARY MODE FOR PRACTICING THE INVENTION

Figures 1, 15:
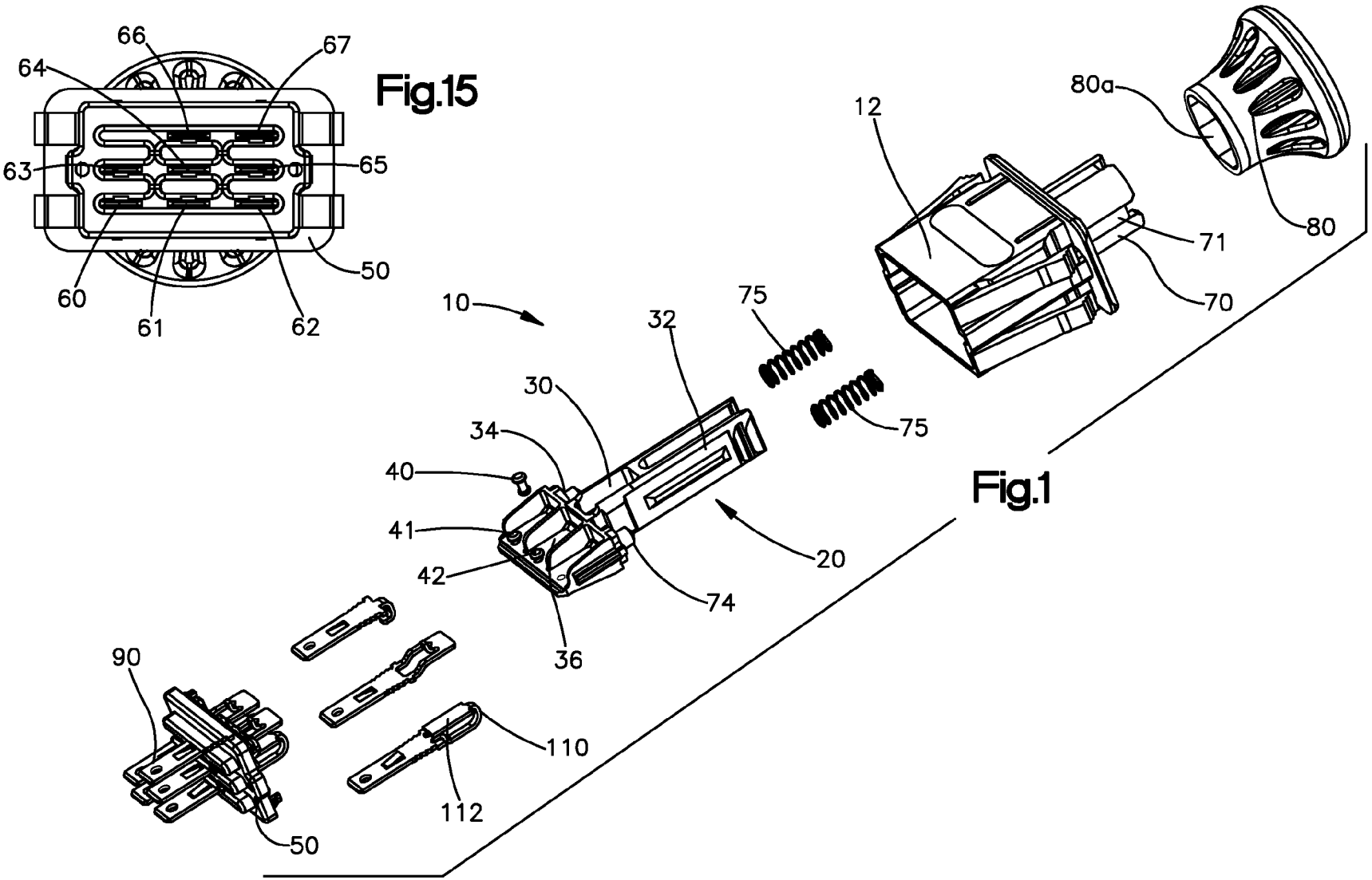
FIG. 1 is an exploded perspective assembly view of a switch constructed in accordance with the invention.
FIG. 15 is an end view of the switch showing a configuration of switch terminals

Turning now to the drawings, FIG. 1 is an exploded perspective view of a switch 10 constructed in accordance with an exemplary embodiment. The switch 10 has a plastic switch housing 12 defining a housing interior 13 (FIG. 3) having an access opening 14 that extends through a wall 16 of the housing to the housing exterior. Fingers 18 flex inwardly when stressed to allow the switch housing to be pushed through an appropriately sized opening in a panel (not shown) and trap the panel between a lip 19 of the housing 12 and the flexible fingers 18.

Figure 5:
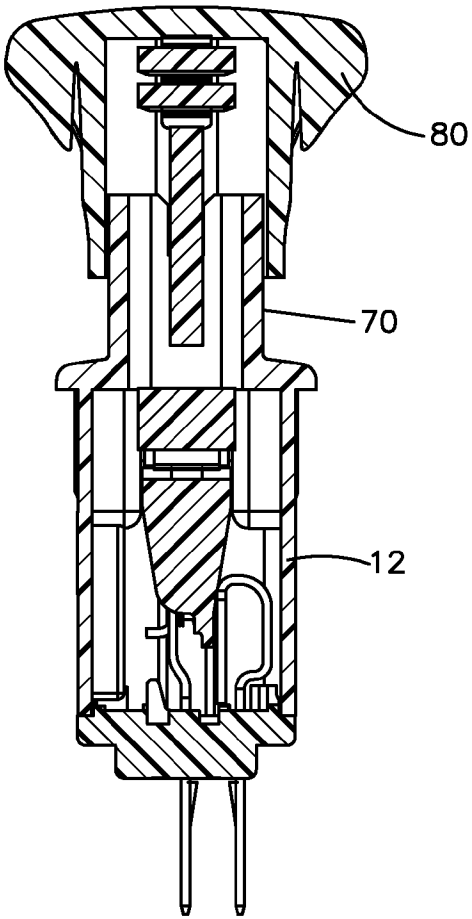
FIG. 5 is a section view of the switch shown in the configuration of FIG. 4.
Figure 7:
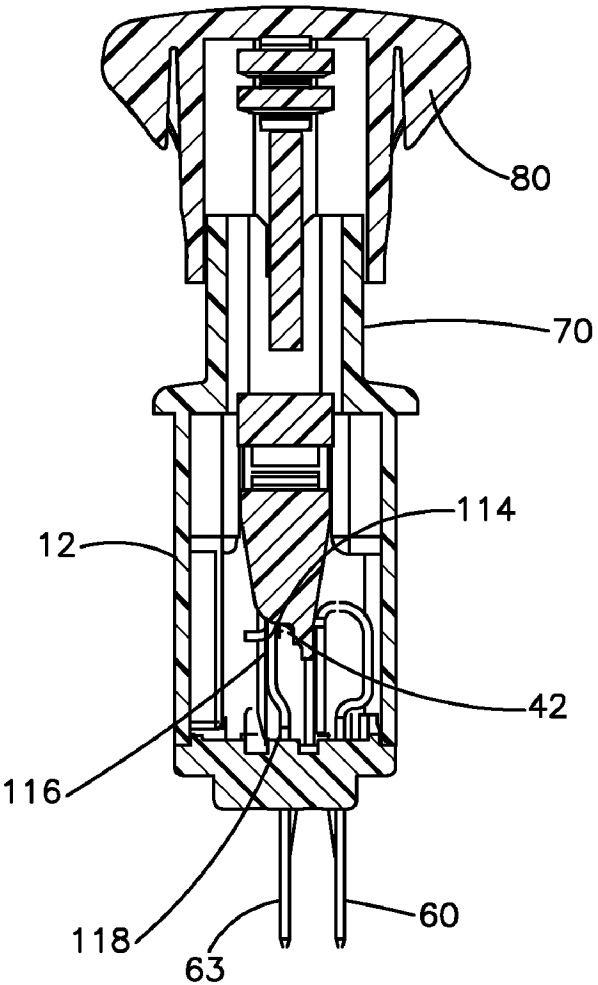
FIG. 7 is a view as seen from the plane defined by the line 7-7 in FIG. 6.
Figure 6:
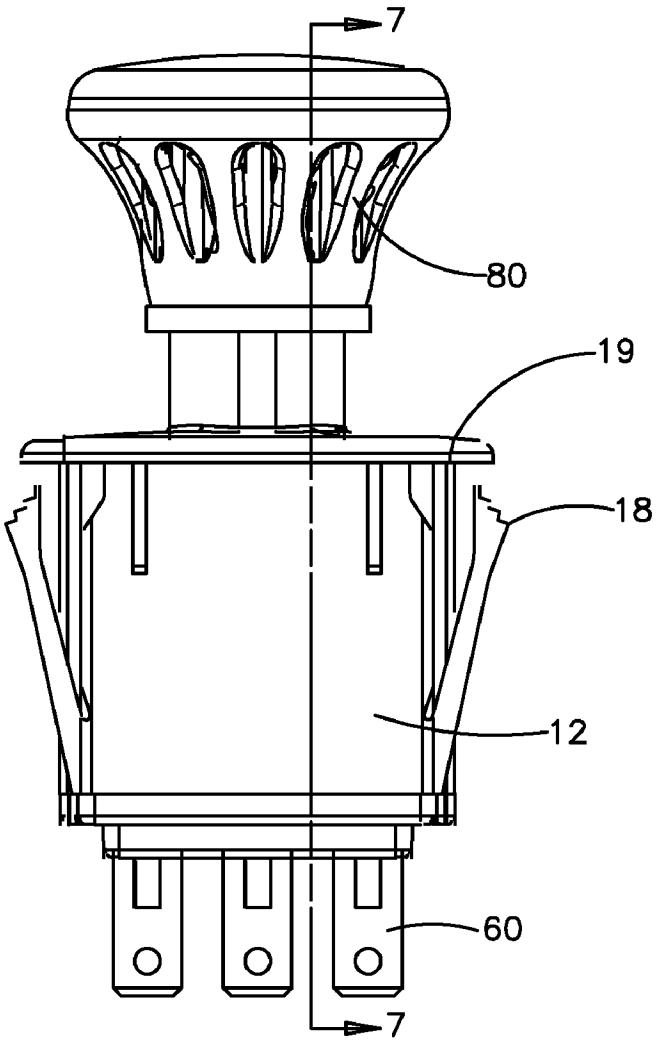
FIG. 6 is a side elevation view of the switch in a momentary position.

An actuator assembly 20 (FIG. 1) includes a plastic shaft 30 constrained by the housing to translate along a path. A user actuated knob 80 moves the shaft 30 from a normal position (FIGS. 2 and 3), to an actuated position (FIGS. 4 and 5), and also to a momentary position (FIGS. 6 and 7). The shaft has an actuating portion 32 which extends outwardly from the housing interior through the access opening 14 of the housing 12 to connect to the knob 80.

A shaft body 34 disposed completely inside the housing defines a generally planar contact support 36 that supports three switch contacts 40-42 that extends through openings 37 in the contact support 36. A housing base 50 positions a plurality of terminals 60-67 having conductive surfaces inside the housing for biased engagement with selected switch contacts to form an electrical path (short) between two terminals when the actuator assembly is in one of either the normal, actuated or momentary positions.

The switch housing includes a neck portion 70 that restrains the shaft to move back and forth along an axis of the shaft neck portion. At least one spring engages the housing and the shaft body to bias the shaft into the housing. In the exemplary embodiment posts 74 extending from a surface of the shaft body 34 position two springs 75 and trap those springs between the shaft body 34 and the wall 16 of the housing.

The actuating knob 80 has an opening 80*a* which leads to a knob interior into which the neck portion 70 of the housing extends during assembly of the switch. The neck portion has notches 71 which key the engagement between the knob and the housing to assure the knob can only be oriented in one specific orientation with respect to the housing. The knob is coupled to and supported by the actuating portion 32 of the shaft 30. An interior surface of the knob is disrupted on opposed sides by latches having beveled portions 82 bounded by ledges 84 (FIG. 10) that engage corresponding hooks 86 extending outwardly from two actuating arms 32*a*, 32*b* of the shaft. During assembly, the shaft 32 is inserted through the opening 14 and out from the neck portion 70 of the housing into engagement with the knob. The shaft is inserted into the knob interior until the hooks 86 flex inward as they engage the beveled portions or surfaces 82 of the knob's interior surface and then snap into place over the ledges 84 of the knob 80. When so assembled the knob 80 will not disengage from the shaft.

Figure 10A:
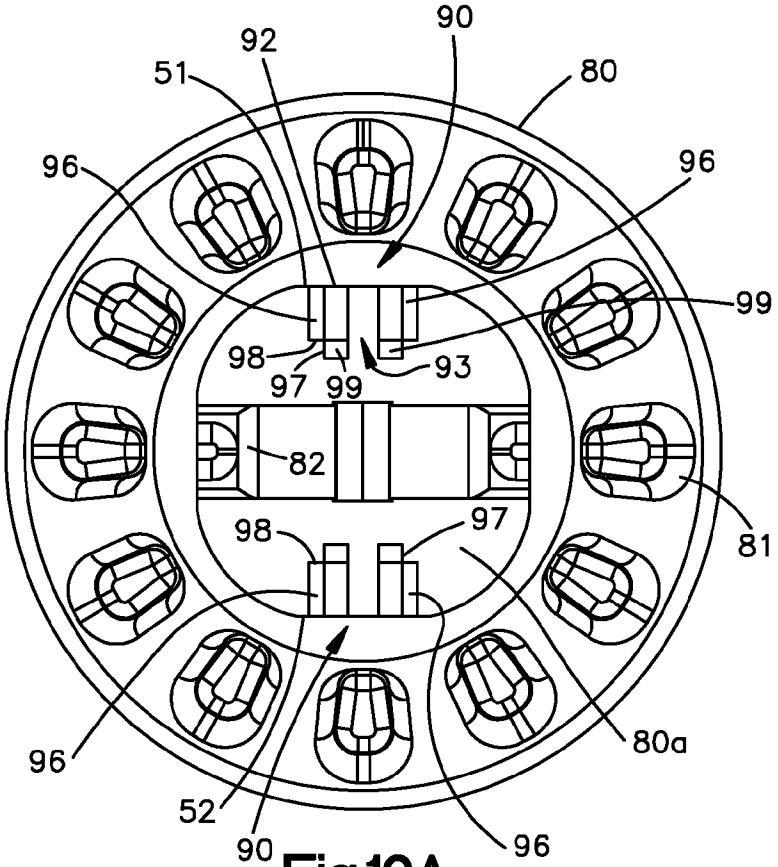
FIG. 10A is an elevation view of the knob showing an interior and shaft engaging structure extending into said interior from inner walls of the knob.
Figure 10:
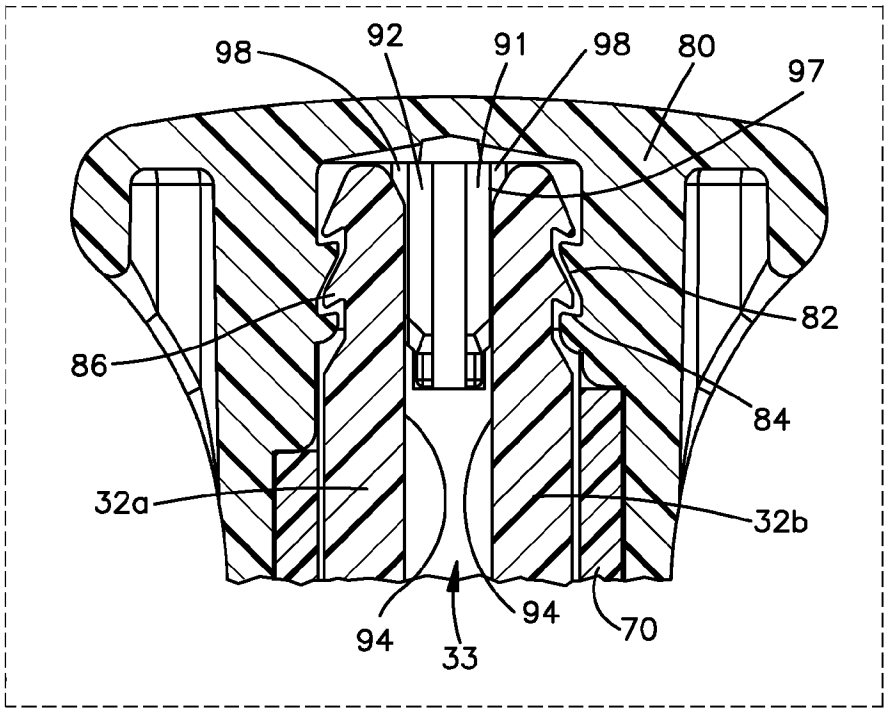
FIG. 10 is an enlarged section view of a switch knob.
Figure 10C:
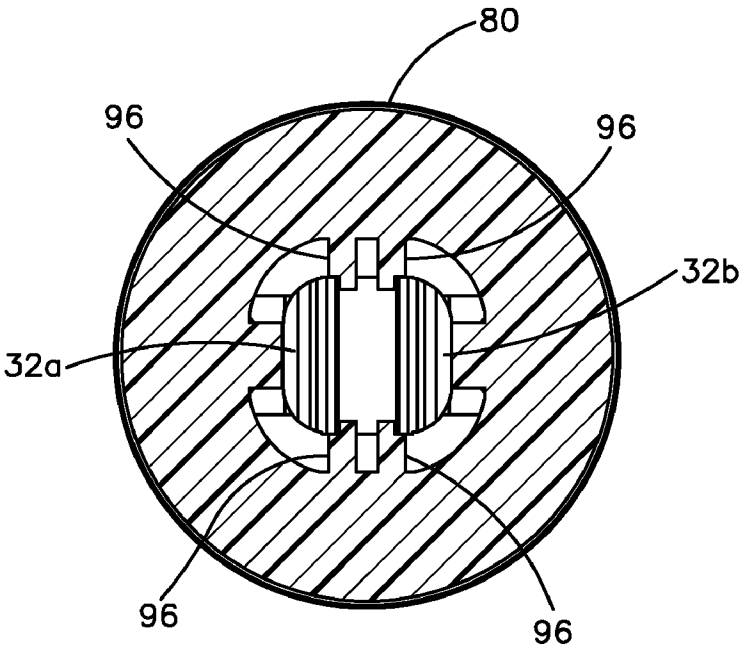
FIG. 10C is a section view as seen from the plane 10C-10C of FIG. 10B.
Figure 10B:
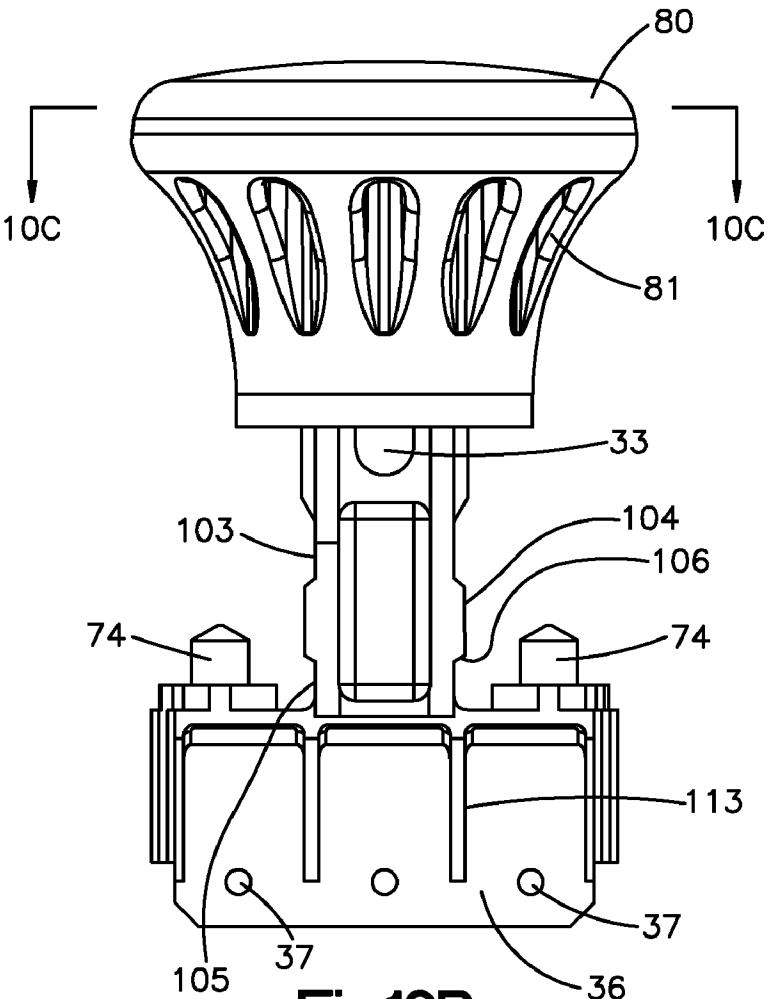
FIG. 10B is an elevation view of the knob coupled to a switch actuator.
Figure 12:
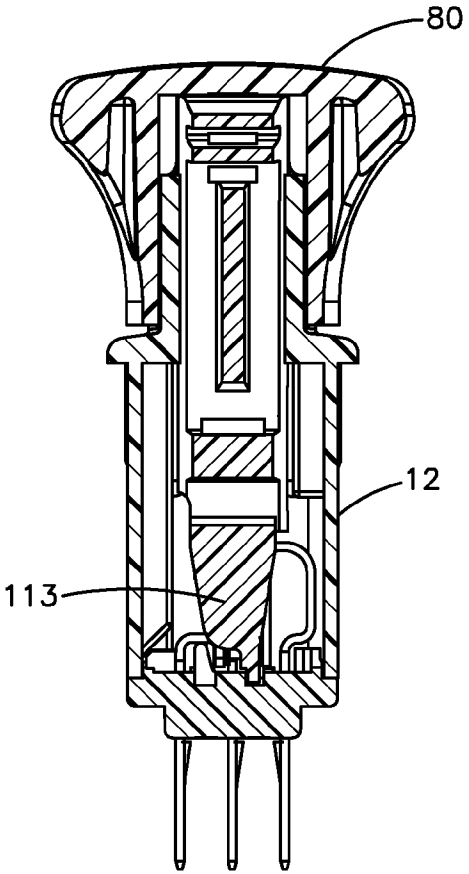
FIG. 12 is a section view as seen from the plane defined by the line 12-12 in FIG. 11.
Figure 11:
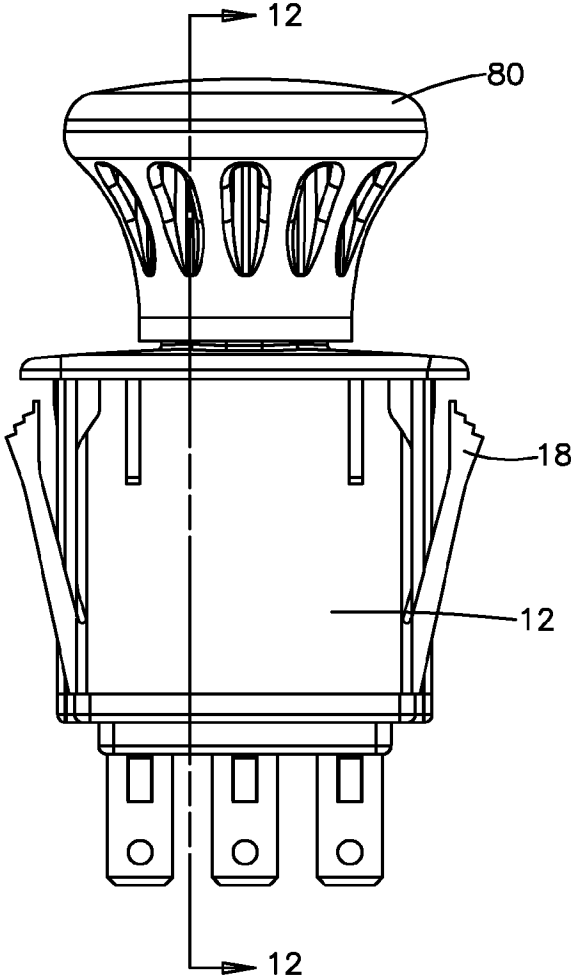
FIG. 11 is an elevation view similar to FIG. 2 from an opposite side of the housing.
Figure 14:
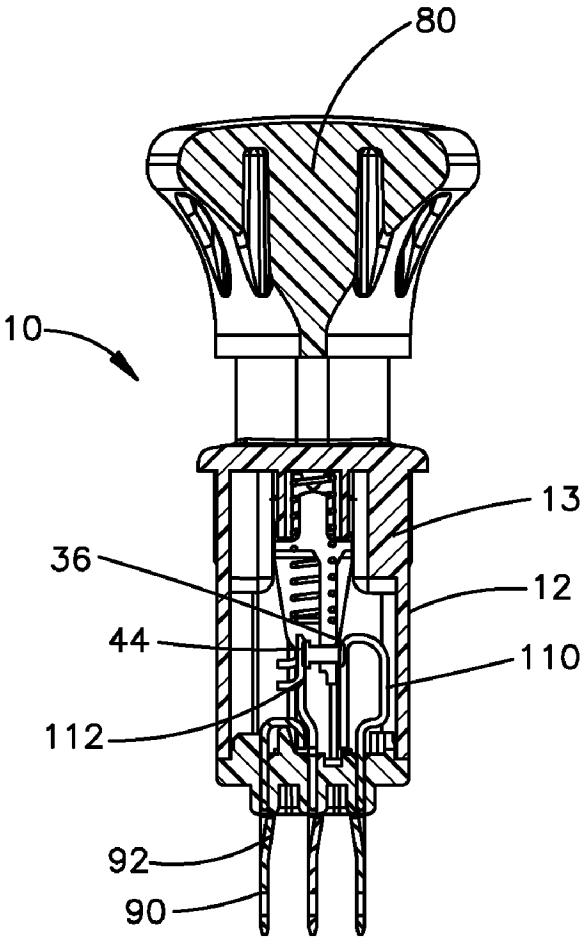
FIG. 14 is a section view as seen from the plane defined by the line 14-14 in FIG. 13.
Figure 13:
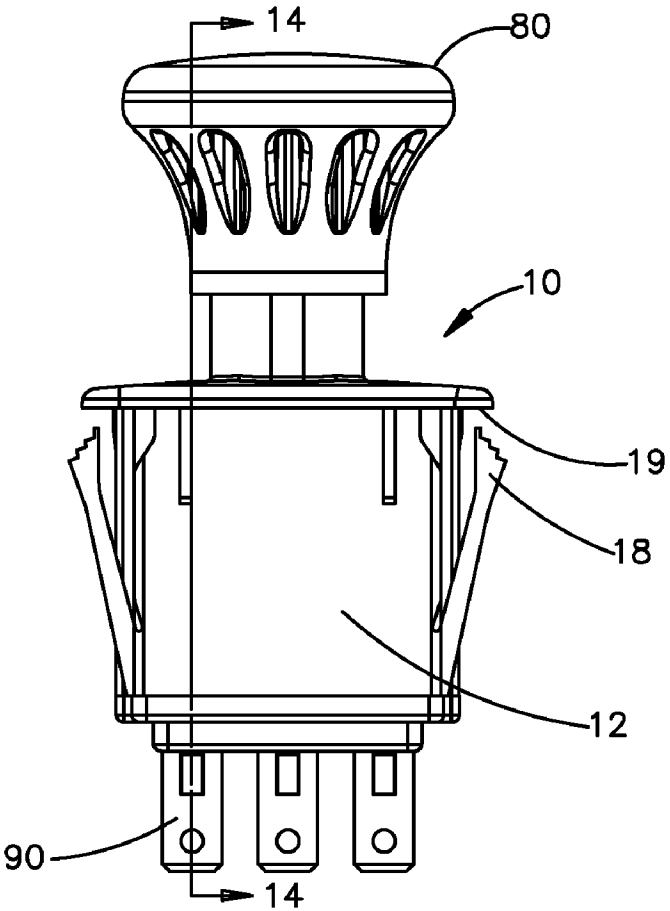
FIG. 13 is view similar to FIG. 4.

The two arms 32*a*, 32*b* that extend into the knob 80 are spaced from each other by a gap 33 that narrows as the arms flex toward each other during insertion. FIGS. 10 and 10A illustrate two guide structures 90 for assuring once the shaft is inserted into the knob 80, the shaft is not removed. Each of the two guide structures 90 includes two elongated bosses 91, 92 that extend a distance (in an exemplary embodiment about one half the length of the knob or about 0.410 inches) from a surface 80*a* and extend outwardly from opposed inner surface 51, 52 of the knob about 0.139 inches. The bosses are spaced apart by a channel 93. The bosses are contacted by inner surfaces 94 of the shaft arms 32*a*, 32*b* as the shaft is inserted into the knob 80.

An outer surface of each of the bosses has a notch at an outwardly facing corner defined by the surfaces 97, 98. The bosses further define ledges 96, 99 that end a short distance below a middle, raised portion of the bosses. The bosses 91, 92 possess a degree of flexibility. Pushing the shaft inward deflects the bosses inward as the teeth or hooks 86 bend inwardly and ride over the beveled portions 82 of the knob. During insertion the arms 32*a*, 32*b* flex toward each other. Once the shaft is seated, however, the outer surfaces of the notch defined by surfaces 97, 98 of the bosses 91, 92 prevent inward flexing of the arms and therefore strongly resist removal of the shaft from the knob.

Figure 3:
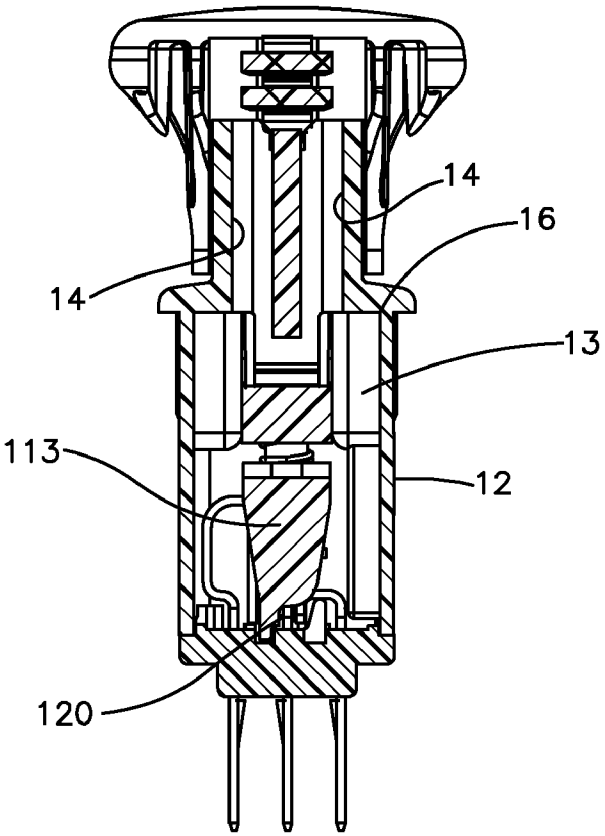
FIG. 3 is a view as seen from the plane defined by the line 3-3 in FIG. 2.
Figure 2:
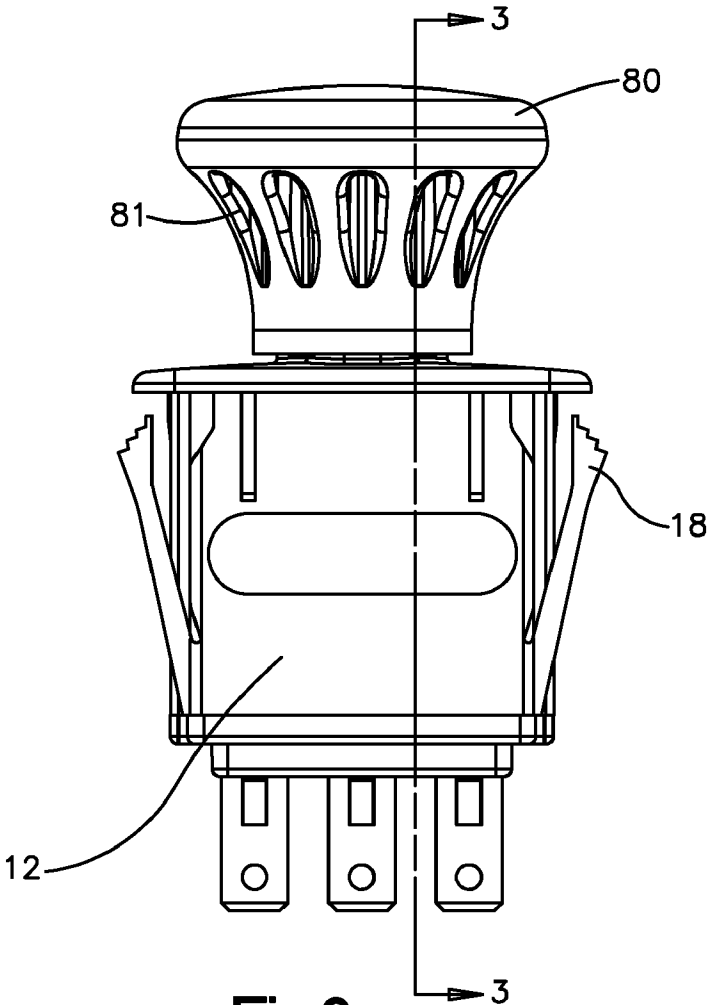
FIG. 2 is a side elevation view of the switch in an non actuated configuration.
Figure 4:
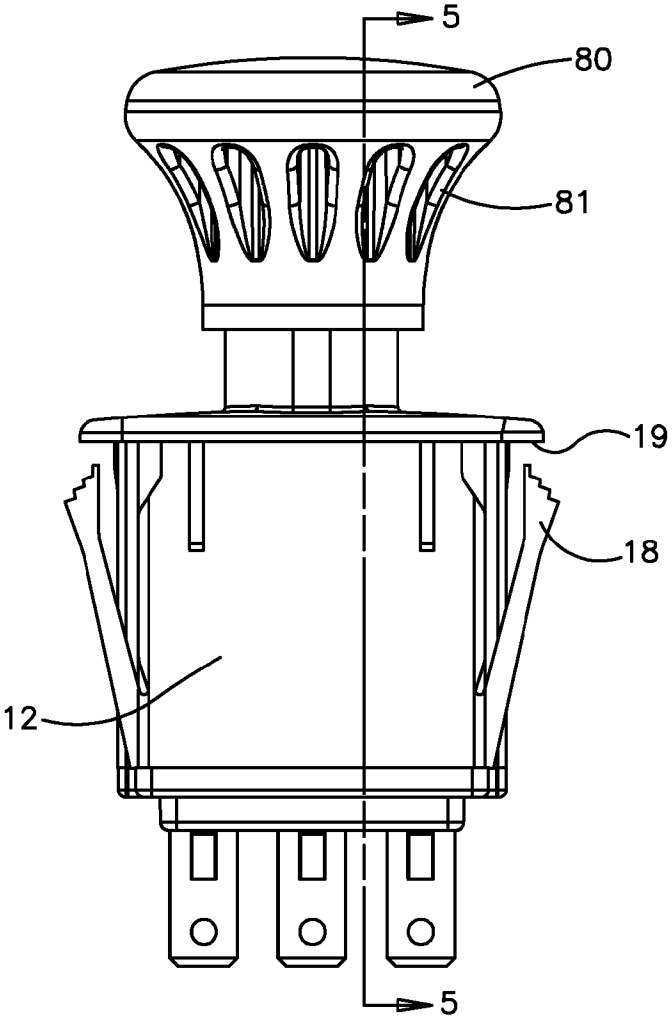
FIG. 4 is a side elevation view of the switch in actuated configuration wherein a knob is biased away from the position of FIG. 2 by a spring.
Figure 9:
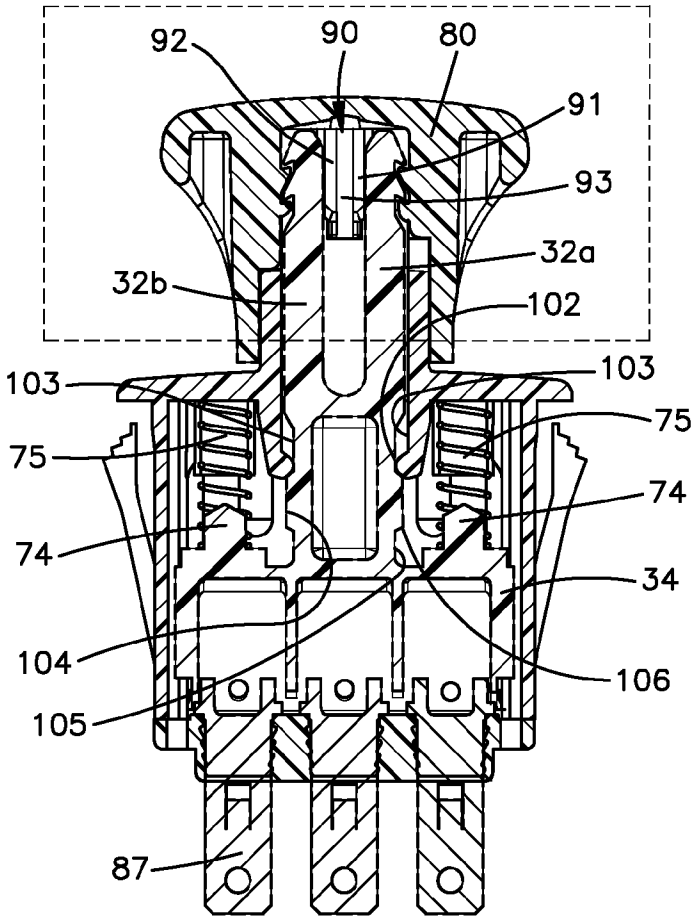
FIG. 9 is a view from the plane defined by the line 9-9 in FIG. 8.
Figure 8:
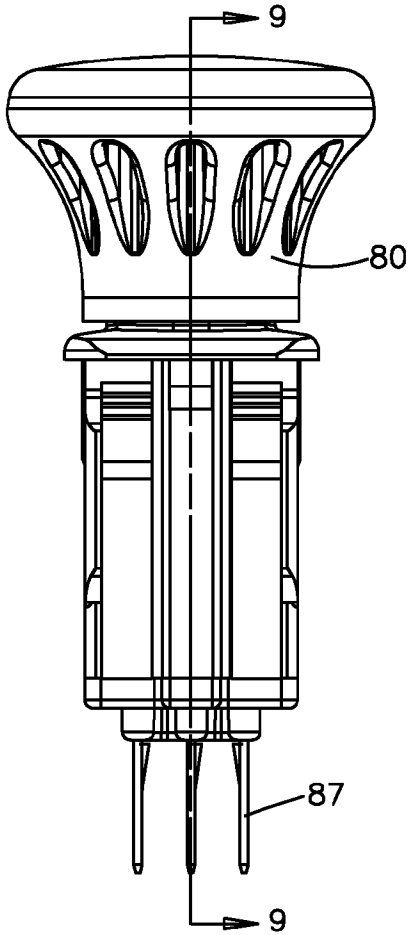
FIG. 8 is a partially sectioned view of the switch in the actuated position (plunger pushed in)

As mentioned above, the knob 20 has three positions for selectively bridging different terminal contact combinations with one or more of the contacts 40-42. FIGS. 2 and 3 depict the switch 10 in its non-actuated state or configuration. FIG. 9 also depicts the switch in this configuration. FIGS. 4 and 5 depict the switch 10 in its actuated state with the knob 80 moved away from the housing 12 to a second stable state. As seen in the FIGS. 4 and 5 depictions, a greater portion of the neck 70 is visible with the switch in this state. It is seen that in the non-actuated state, enlarged lobes 102 or detents integral with the switch housing are seated within two depressions 103 in the actuator shaft body 34. As the user grasps the knob 80 and pulls to actuate the switch, the lobes 102 flex outwardly and slide across an outer surface 104 of the body 34 as the shaft and knob are moved along a generally linear travel path. When the knob reaches the actuated position the lobes 102 seat within a second depression 105 bordered by a beveled region 106 of the shaft body 34 to provide an actuated (second stable) switch configuration.

Figure 22:
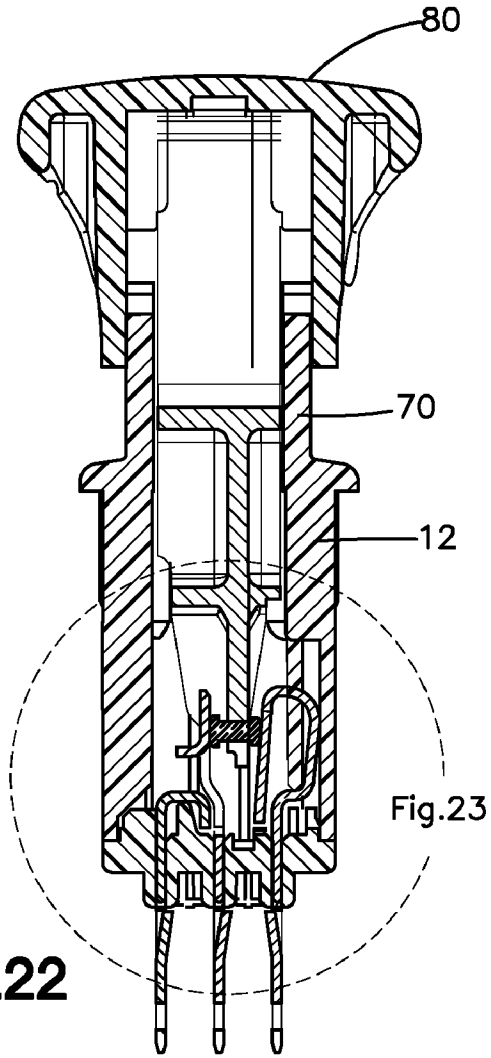
FIG. 22 is a section view as seen from the plane 22-22 of FIG. 21.
Figure 21:
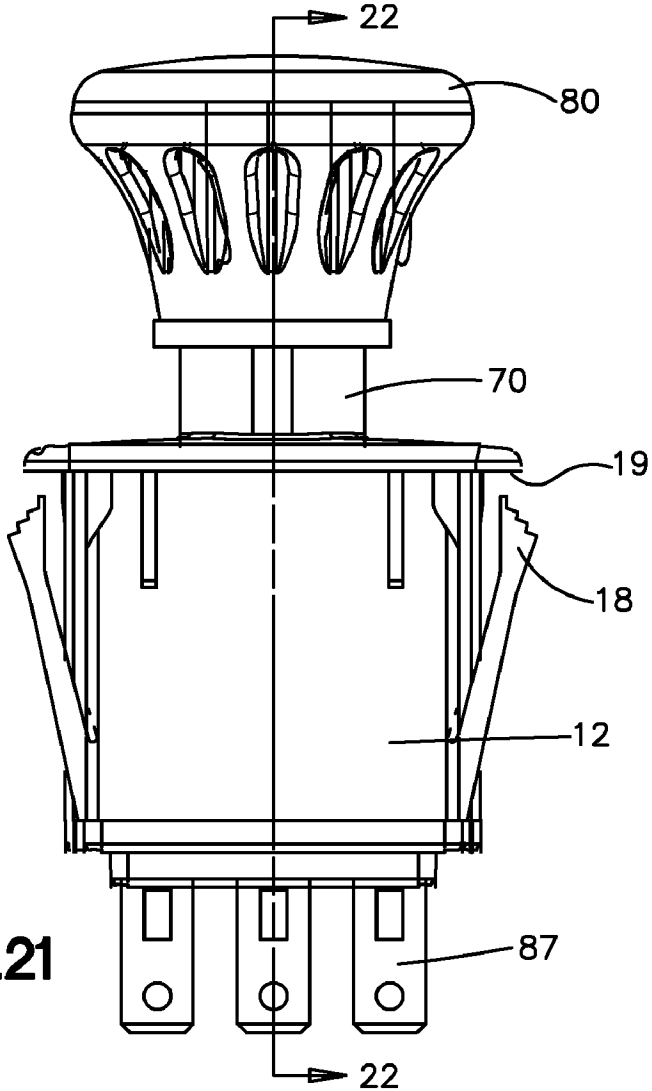
FIG. 21 is an elevation view of a switch housing.
Figure 24:
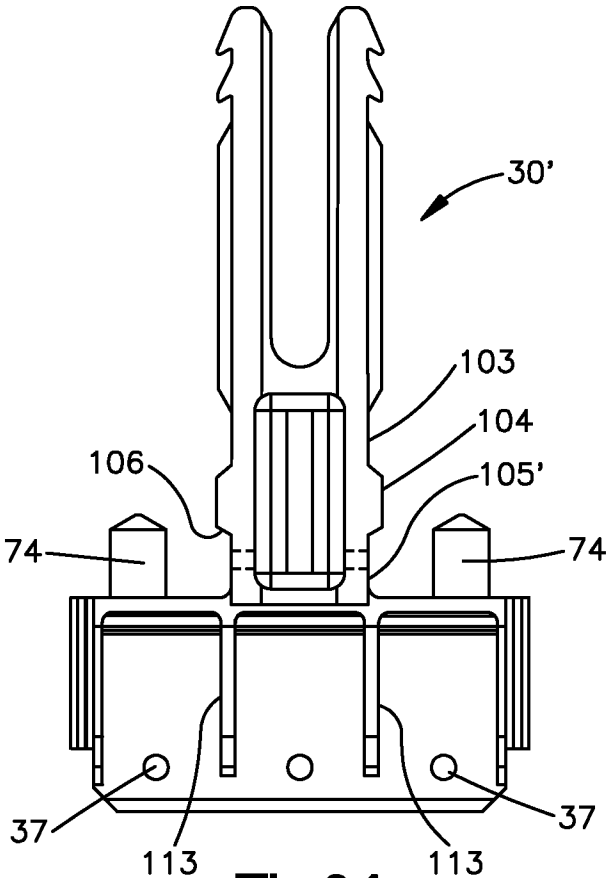
FIG. 24 is an elevation view of a shaft used with a switch embodiment having a momentary terminal.
Figure 23:
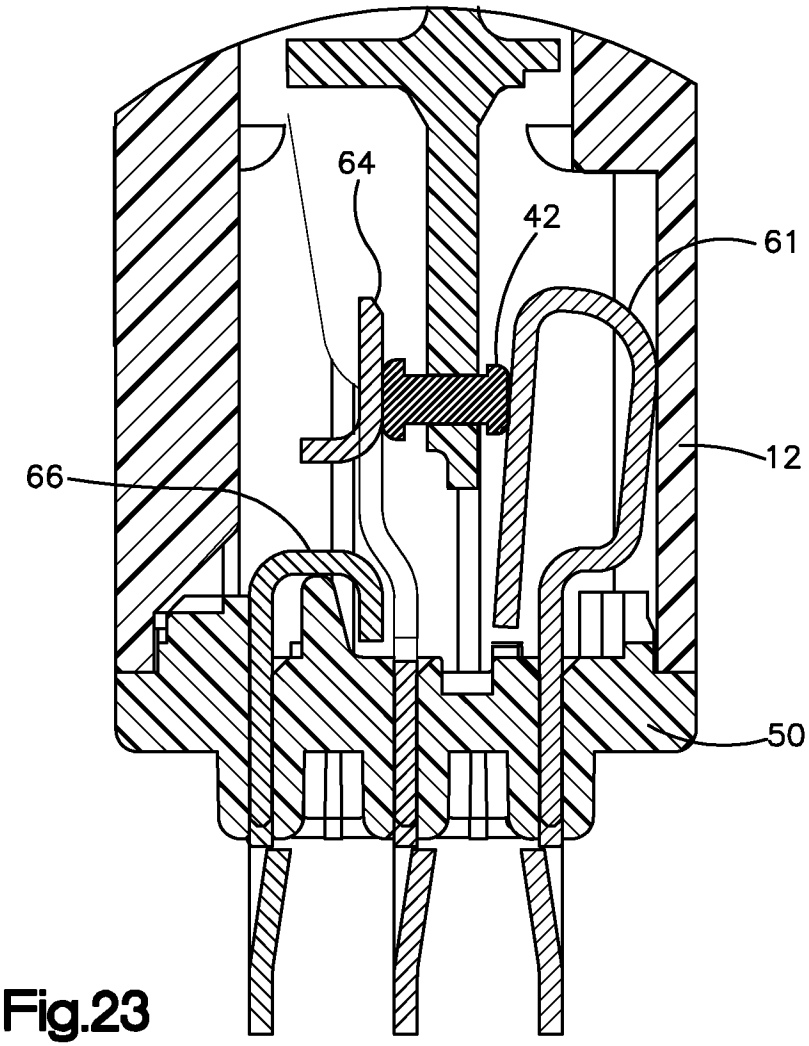
FIG. 23 is an enlarged portion of the section view of FIG. 22.

Turning to FIG. 24, there is depicted a shaft configured to provide a momentary position for the knob extended further from the housing than the actuated position shown in FIGS. 21 and 22. In this embodiment, the depression 105' has a longer length than the depression 105 depicted in FIG. 9 to allow the actuator 30' to be pulled out of the housing a greater extent to allow the rivet contact to bridge between the surface 114 of a momentary contact. Releasing the knob allows the springs 75 to bring the knob back toward the housing so that the lobe or detent 102 to rest against the surface 106 in the stable actuated state.

Figure 16B:
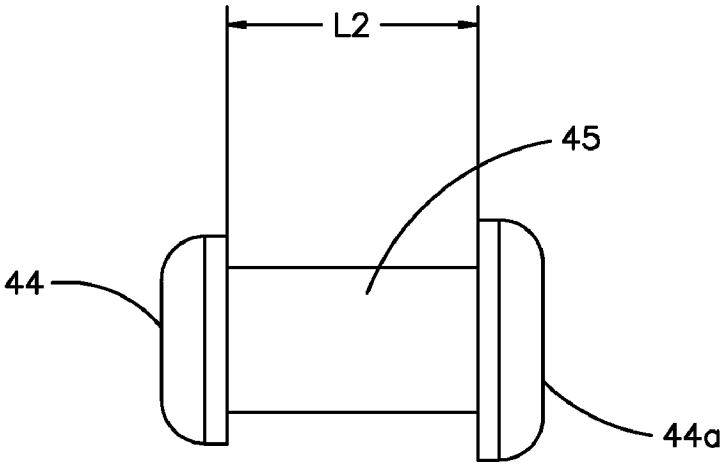
FIGS. 16A-16C are detailed depictions of a switch contact that selectively bridges the terminals of the switch.
Figure 16C:
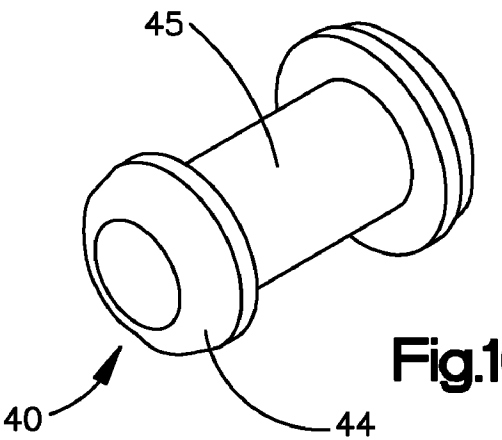
Figure 16A:
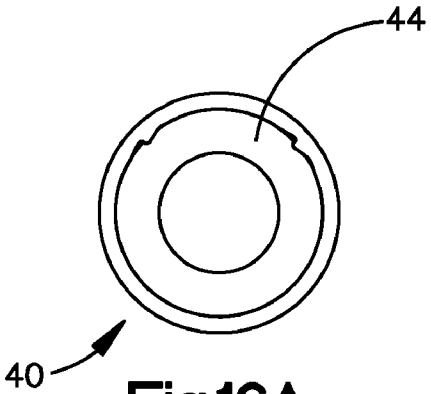

The generally planar section 36 of the shaft supports a generally linear array of contacts 40-42, wherein each contact is constructed from a rivet and provides the mechanism for opening or closing an associated circuit. In accordance with the exemplary embodiment shown in FIGS. 16A, 16B, and 16C, the contacts have rounded ends 44 and an intermediate or center portion 45 that is slightly longer than a thickness of the generally planar support section 36 of the shaft. Their length allows a limited amount of back and forth movement of the rivets as the switch is actuated by a user. This design maintains good engagement between the terminal and the contact so that, for example, manufacturing tolerances of the position within the housing of the terminal do not adversely affect or degrade electrical engagement.

Figure 20:
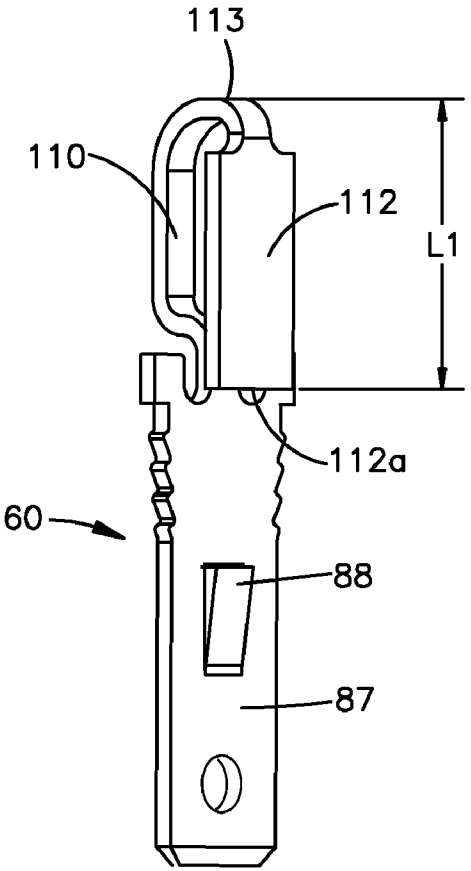
FIG. 20 is an enlarged perspective view of a common terminal with which one of the other three terminals is brought into electrical engagement.

A common terminal (such as the three terminals 60, 61, 62 of FIG. 15) is spaced on one side of the contact support 36 that supports the rivet contacts. The common terminal defines a loop 110 within the interior of the housing and has a generally flat contact engaging portion 112 which extends a length within the housing sufficient to engage an enlarged exposed head portion 44*a* of a corresponding metal contact (40, 41, or 42) regardless of whether the switch is in the normally open, normally closed or momentary position. A length L1 (FIG. 20) from an end 113 of the common terminal to an end 112*a* of the flat contact engaging portion 112 is approximately 0.472 inches. The total length of the common terminal is about 1.25 inches and the metal sheet from which the terminal is formed in about 0.032 inches thick.

The common terminal (FIG. 20) exerts a force against one end or head 44 of the contact. Due to the longer length of the center section 45 of the contact, if the terminal is not precisely positioned, the common terminal acts as a spring and moves the contact into engagement if the terminal is positioned slightly to the left (as depicted in FIG. 3 engaging a normally closed terminal). If the terminal is shifted to the right, the entire contact can shift slightly to the right (against the restoring force of the common terminal) during contact. Additionally, with use, the contact wears and this does not adversely affect electrical engagement since the common terminal can shift the contact to the left to maintain good engagement as such wear occurs. Stated another way, as the contact head engaging the non-common terminal wears, the common terminal forces the head into positive engagement by moving it slightly to the left from its original (non-worn) position.

These contacts 40-42 are formed from metal rivets made using orbit or spin forming methods that roll the enlarged head over on the common side of the support 36 after they pushed through the openings 37 of the support 36. A length L2 (FIG. 16B) between enlarged ends 44, 44*a* of a contact is, in an exemplary embodiment 0.112 inches.

Molding of the shaft was facilitated by inclusion of walls 113 between rivets on the actuator. The actuator is plastic and is formed by molding. Use of a mold design that forms the walls 113 helps promote uniform flow of plastic into an end region of the actuator. Additionally the walls 113 physically separate the different contacts from each other and avoid an possibility of shorting between metal terminals.

As seen in the drawings the switch 10 includes different types of electrically conductive terminals. The exemplary embodiment has a common terminal, a normally open terminal, a normally closed terminal and a momentary terminal. Each of the three types of terminals has an elongated metal leg 90 which extends from the housing base 50 and forms a part of a switch circuit controlled by the switch 10. During assembly the terminal is inserted through the base and a flexing portion 88 of the terminal bends slightly to pass through openings in the base. Once it passes through one of these openings, the flexing portion 88 snaps back to its original configuration and securely fixes the terminal to the base. The base 50 is then secured to the housing by means of ultrasonic welding or the like.

Figure 19:
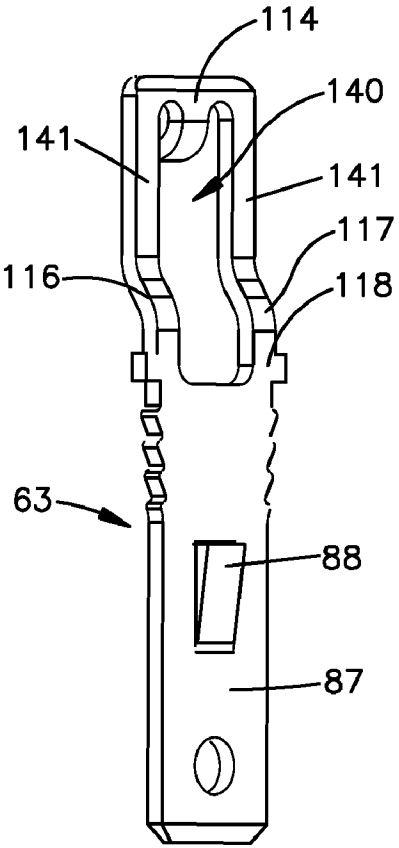
FIG. 19 is an enlarged perspective view of a momentary terminal.

A momentary terminal 63 (FIG. 19) defines a relatively flat distally located contact engaging surface 114 that is bent away from the contact support. An intermediate portion 116 that extends away from the base 50 at an angle supports the engaging surface. The intermediate portion is connected by a bend 117 in the terminal to a second elongated straight portion 118. In combination the portions 116, 118 space the contact engaging portion 114 a maximum distance from the base 50 of the housing at least relative to the contact engaging portions of others of the switches terminals. The contact surface 114 is spaced from the planar contact support 63 to occupy a plane that generally coincides with the plane occupied by contact engaging portions of surfaces of the other terminals. The momentary terminal is illustrated as moved into engagement with the middle contact 42 in FIG. 7.

The normal or unactuated position of the switch 10 is shown in FIGS. 2 and 3 with the knob 80 biased to this position by the springs 75 trapped inside the housing and the detent. A normally closed terminal (66) has a generally flat contact engaging portion 120 supported in a position within said housing interior such that the flat contact engaging portion 120 is nearest the base 50. An extreme distal end 122 of this terminal forms an angle with the base so that as the moving contact (40 or 41) reaches the position of the normally closed terminal's contact engaging portion it encounters low resistance to movement. A normally closed contact is shorted to the common terminal when the knob 80 is positioned closest to the housing due to the biasing action of the springs.

Figure 18:
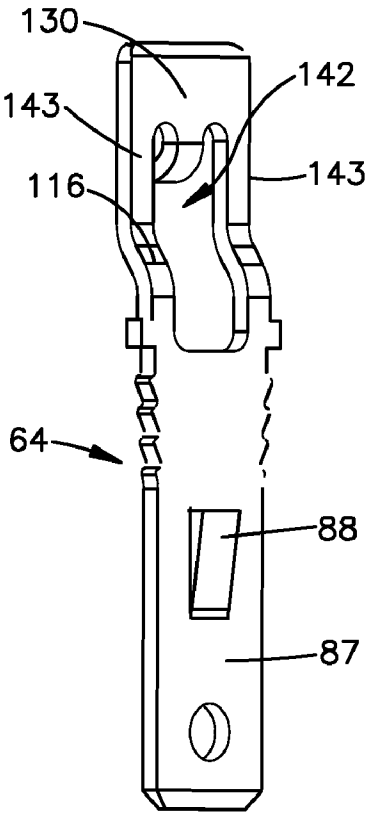
FIG. 18 is an enlarged perspective view of a normally open terminals.
Figure 17:
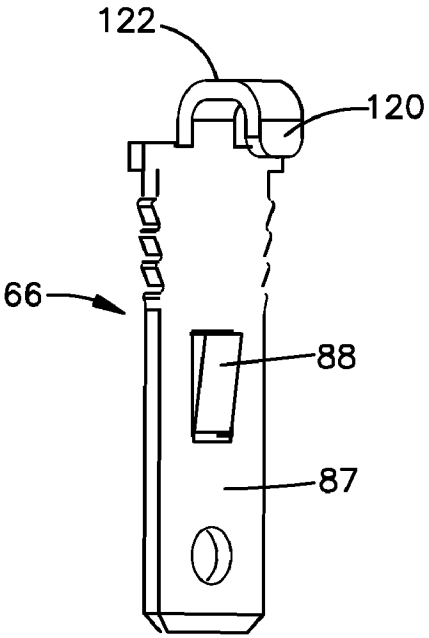
FIG. 17 is an enlarged perspective view of a normally closed terminals.

A normally open terminal (64) has a generally flat contact engaging portion 130 supported by a doubly bent intermediate portion 132 (FIG. 18) that spaces the flat contact engaging portion 130 from the base 50 of the housing an amount intermediate the contact engaging portions of the normally closed momentary terminals.

The momentary and normally open terminals define notches 140, 142 bound by elongated metal strips 141, 143. The gaps extend along their respective terminals a length sufficient to isolate them from the rivet contacts with the switch assembly in the non-actuated position. Thus in the non-actuated position a contact can extend through a notch in either the momentary or normally open contact to engage the normally closed contact (if present). Furthermore, the notch 140 in the momentary contact is long enough to isolate the terminal from its associated contact with the actuator assembly in both the normal and the actuated position so that the terminal 63 is bridged only in the momentary position.

The common terminals of the switch are constructed from beryllium copper (commercially available as CL51000, 100-110 ksi tensile strength) and the regular (non-common) terminals are made from brass. One of the contacts is designed to conduct high current (15 amps) and is made from a silver copper alloy (approx 90% silver and 10% copper). The other contacts are copper rivets and are rated at somewhat less than 15 amps of current carrying capacity.

While the exemplary embodiment has been described with a degree of particularity, it is the intent that the invention include all modifications and alternations from the disclosed design falling within the spirit or scope of the appended claims.

What is claimed:

1. A method of controlling a circuit comprising the steps of:

a) mounting a contact to a switch actuator for movement back and forth through a switch housing interior by i) providing a rivet and passing said rivet through an opening in a generally planar mounting support such that an enlarged end of the rivet is exposed on one side of the generally planar mounting support and ii) enlarging an opposite end of the rivet to secure said rivet to the mounting support;

b) positioning a pair of electrically conductive spaced apart terminals for selectively engaging the exposed ends of the rivet within the housing, wherein one terminal has a first rivet engaging surface on one side of the planar mounting support and a second terminal spaced from the one terminal has a second rivet engaging surface on an opposite side of the planar support; and c) moving the rivet along a travel path to selectively bridge a gap between the first and second rivet engaging surfaces of the spaced apart terminals.

2. The method of claim 1 wherein the switch actuator comprise an elongated actuator portion that extends outside the switch housing and further comprising attaching a knob to the switch actuator outside the switch housing by means of an interfering or snap engagement that inhibits separation of the knob from the switch actuator.

3. The method of claim 1 wherein multiple switch contacts are supported by the switch actuator and wherein two terminals are positioned within the housing relative the actuator for selective engagement with the contacts.

4. The method or claim 3 wherein the each of multiple switch contacts is maintained in engagement with a specifically configured terminal having a generally planar contact surface regardless of the position of the switch contact within said housing.

5. Switch apparatus comprising:

a) a switch housing defining a housing interior having an access opening that extends through a wall of said housing to a housing exterior;

b) an actuator assembly comprising i) a shaft constrained by said housing to translate along a path including a normal position and an actuated position and having an actuating portion which extends out of the housing interior through the access opening of said housing;

ii) a shaft body disposed inside said housing including a contact support;

iii) one or more switch contacts inside said housing that are supported by the contact support and have enlarged exposed ends connect by a rigid intermediate contact body that extend beyond opposed sides of said contact support; and c) a plurality of terminals having conductive surfaces for biased engagement with selected switch contacts to form an electrical path between terminals through the contacts when the actuator assembly is in one of either the normal or actuated positions;wherein a common terminal has a contact engaging portion which extends a length within the housing sufficient to engage an enlarged exposed end of a corresponding contact in one of a normally open and a normally closed position of the actuator assembly.

6. A switch according to claim 5 wherein the switch housing include a neck portion for restraining the plunger to slide along an axis of the neck portion, and at least one spring engaging the housing and the shaft body to bias the shaft to a normal position.

7. A switch according to claim 5 additionally comprising a knob attached to the actuating portion of the shaft, said knob defining an interior surface that has beveled portions bounded by ledges that engage hooks extending outwardly from and wherein the actuating portion of the shaft such that during assembly the shaft is inserted through the opening in the housing to engage the knob and inserted into the knob until the hooks flex inward as they engage the beveled portions and then snap into place over the ledges of the knob.

8. A switch in accordance with claim 5 wherein the contact support comprises a generally planar contact support including an array of throughpassages which position a generally linear array of rivet contacts, wherein each rivet forms part of a switched circuit.

9. A switch in accordance with claim 5 wherein the contact support defines one or more throughpassages to accommodate one or more contacts and the switch contacts have an intermediate portion slightly longer than a thickness of the generally planar section of the shaft body to allow a limited amount of back and forth movement of said contacts with respect to the shaft body as the switch is actuated by a user.

10. The switch of claim 5 wherein the housing includes a terminal support wall and one terminal comprises an elongated metal leg which extends through a terminal support wall of the housing and has a contact engaging portion supported by a bent intermediate portion that spaces the contact engaging portion a distance from the contact support.

11. The switch of claim 10 wherein the one terminal defines a notch that extends along a length of the terminal an amount sufficient to isolate said one terminal from an associated contact with the switch actuator assembly in a non-actuated position.

12. The switch of claim 10 wherein the one terminal is a momentary terminal is bent away from the contact support along a region inside said housing to space said contact engaging portion of the momentary terminal an amount from the contact support so that movement of the support to the momentary position causes an end of the contact associated with the momentary terminal to slide over a surface of the contact engaging surface of said momentary terminal.

13. The switch of claim 5 wherein the housing includes a terminal support wall and further comprises a normally closed terminal including an elongated metal leg which extends through the terminal support wall of the housing has a contact engaging portion supported in a position within said housing interior such that the contact engaging portion completes a circuit when an associated contact is nearest the terminal wall of the housing as positioned by the switch actuator.

14. The switch of claim 5 wherein the housing includes a terminal support wall and further comprising a normally open terminal including an elongated metal leg which extends through a terminal support wall of the housing and has a contact engaging portion supported by a bent intermediate portion that spaces the contact engaging portion from the terminal wall of the housing an amount intermediate two other positions of an associated contact within the housing corresponding to a normal and a momentary position of the switch actuator assembly.

15. Switch apparatus comprising:

a) a switch housing defining a housing interior having an access opening that extends through a wall of said housing to a housing exterior;

b) an actuator assembly comprising i) a shaft constrained by said housing to translate along a path including a normal position and an actuated position and having an actuating portion which extends out of the housing interior through the access opening of said housing comprising two flexible arms;

ii) a shaft body disposed inside said housing including a contact support; and iii) one or more switch contacts inside said housing having exposed ends that extend beyond opposed sides of said contact support;

c) a plurality of terminals having conductive surfaces for engagement with selected switch contacts to form an electrical path between terminals when the actuator assembly is in one of either the normal or actuated positions; and d) a knob attached to the actuating portion of the shaft, said knob defining an interior surface that has beveled portions bounded by ledges and interior bosses which extend inwardly from interior walls of the knob to engage outer sides of the two flexible arms of said shaft;

e) said actuating portion of said shaft comprising hooks extending outwardly from the actuating portion of the shaft such that during assembly the shaft is pushed through the access opening in the housing to engage the knob and inserted into the knob until the hooks flex inward as they engage the beveled portions and then snap into place over the ledges of the knob.

16. The switch apparatus of claim 15 wherein the housing defines one or more flexible detents extending into a housing interior and wherein the shaft body defines depressions into which the detents seat to define a stable actuator assembly position.

17. The switch apparatus of claim 16 wherein the shaft body defines one or more posts and additionally one or more springs positioned by said posts to bias the actuator assembly into the housing.

18. The switch apparatus of claim 15 wherein the bosses have notches along their length into which the sides of the flexible arms extend.

19. Switch apparatus comprising:

a) a switch housing defining a housing interior having an access opening that extends through a wall of said housing to a housing exterior;

b) an actuator assembly comprising i) a shaft constrained by said housing to translate along a path including a normal position and an actuated position and having an actuating portion which extends out of the housing interior through the access opening of said housing;

ii) a shaft body disposed inside said housing including a generally planar contact support;

iii) one or more switch contacts inside said housing having exposed ends that extend beyond opposed sides of said contact support; and c) a plurality of terminals including a common terminal, a normally open terminal, a normally closed terminal and a momentary terminal having conductive surfaces for biased engagement with selected switch contacts to form an electrical path between terminals when the actuator assembly is in one of either the normal or actuated positions.

20. The switch of claim 19 wherein each terminal comprises an elongated metal leg which extends through a terminal support wall of the housing for inclusion in a switch circuit and further comprising one of:

a) a loop having a contact engaging portion which extends a length within the housing sufficient to engage a corresponding contact regardless of whether the switch is in the normally open, normally closed or momentary position;

b) a generally flat contact engaging portion supported by a bent intermediate portion that spaces the flat contact engaging portion a maximum distance from the terminal wall of the housing;

c) a generally flat contact engaging portion supported in a position within said housing interior such that the flat contact engaging portion is nearest the terminal wall of the housing so that the generally flat contact engaging portion is engaging the contact when the knob is closest the housing; or d) a generally flat contact engaging portion supported by a bent intermediate portion that spaces the flat contact engaging portion from the terminal wall of the housing an amount intermediate the terminals of options b and c.

21. Switch apparatus comprising:

a) a switch housing defining a housing interior having an access opening that extends through a wall of said housing to a housing exterior and includes a terminal support wall;

b) an actuator assembly comprising i) a shaft constrained by said housing to translate along a path including a normal position and an actuated position and having an actuating portion which extends out of the housing interior through the access opening of said housing;

ii) a shaft body disposed inside said housing including a generally planar contact support;

iii) one or more switch contacts inside said housing having exposed ends that extend beyond opposed sides of said contact support; and c) a plurality of terminals having conductive surfaces for biased engagement with selected switch contacts to form an electrical path between terminals when the actuator assembly is in one of either the normal or actuated positions wherein one terminal comprises a common terminal including an elongated metal leg which extends through the terminal support wall of the housing and has a loop having an elongated contact engaging portion which extends a length within the housing sufficient to engage a corresponding contact regardless of a position of the switch actuator assembly in the housing.

22. A method of controlling a circuit comprising the steps of:

a) mounting a contact to a switch actuator for movement back and forth through a switch housing interior by positioning the contact within a thrupassage in a contact support such that enlarged opposite ends of the contact are exposed on opposite sides of the generally planar mounting support and are spaced from said opposite sides to allow limited back and forth movement of the contact with respect to the contact support;

b) positioning a pair of electrically conductive spaced apart terminals for selectively engaging the exposed ends of the contact within the housing, wherein one terminal has a first contact engaging surface on one side of the contact support and a second terminal spaced from the one terminal has an elongated spring that includes a second contact engaging surface on an opposite side of the contact support; and c) moving the contact along a travel path to selectively bridge the first and second contact engaging surfaces of the spaced apart terminals while allowing the second terminal to flex while maintaining biased engagement with the contact.

* * * * *